US005163676A

United States Patent [19]

Taub

[11] Patent Number: 5,163,676

[45] Date of Patent: Nov. 17, 1992

[54] PORTABLE GAME ASSEMBLY

[76] Inventor: Ronald H. Taub, 1154 Sheridan Rd., Highland Park, Ill. 60035

[21] Appl. No.: 653,047

[22] Filed: Feb. 11, 1991

[51] Int. Cl.[5] ..... A63B 63/08

[52] U.S. Cl. ..... 273/1.5 R; 273/396; 248/412

[58] Field of Search ..... 273/1.5 R, 1.5 A, 396, 273/397; 248/411, 412

[56] References Cited

U.S. PATENT DOCUMENTS

| | | | |
|---|---|---|---|
| 689,855 | 12/1901 | Copeland | 248/412 X |
| 844,670 | 2/1907 | Frankel | 248/412 |
| 1,854,932 | 4/1932 | Gottlieb | 248/411 X |
| 1,970,624 | 8/1934 | Recker | 248/412 |
| 2,379,572 | 7/1945 | Gibson | 273/1.5 R X |
| 2,742,082 | 4/1956 | Lief | 248/412 |
| 2,838,308 | 6/1958 | Polite | 273/396 X |
| 2,889,149 | 6/1959 | Williams | 273/1.5 R X |
| 4,793,611 | 12/1988 | Thornell | 273/1.5 R |
| 4,974,841 | 12/1990 | Jarriel et al. | 273/1.5 R |
| 5,011,104 | 4/1991 | Fang | 248/412 X |

FOREIGN PATENT DOCUMENTS

| | | | |
|---|---|---|---|
| 1364290 | 8/1974 | United Kingdom | 273/396 |

*Primary Examiner*—Paul E. Shapiro

*Attorney, Agent, or Firm*—Michael G. Berkman

[57] ABSTRACT

A self-standing game assembly for indoor and outdoor use and having a standard including a bounce-back base supporting a height adjustable post. A post-mounted backboard projects upwardly from the post and a stress-responsive safety hoop or ring, pivotally secured at a base of the backboard, carries a hanging, tubular basket. The backboard is imprinted with indicia designating reference impact areas for use during the playing of various games involving a thrown ball directed toward the backboard. The base of the assembly is generally wedge-shaped, and is contoured to present to a ball dropped through the basket a pitched or angled impact face which serves to direct a ball which has fallen through the hoop, and which has then impinged on the pedestal to return toward a player positioned in front of and facing the backboard.

2 Claims, 4 Drawing Sheets 160
154
150
144
114
30
156
108
100
146
106
104
136
118
138
230
134
122
140
130
124
40
164
174
166
7
112
170
172
158

PORTABLE GAME ASSEMBLY

FIELD, AND BACKGROUND OF THE INVENTION

The present invention relates to a self-standing game assembly for indoor and outdoor use and of the general type which includes a standard supporting a backboard below which there is a hoop-carried basket. More particularly, the present invention is directed to a game assembly useful in the playing of basketball and other games, and in which the backboard is imprinted with indicia defining the impact areas toward which the game ball may be directed. Important features of the game assembly of the invention are that the basket itself is responsive to excessive forces applied thereto to pivot or break-away from its horizontally standing mode, and to swing and assume a vertical disposition. The base of the standard upon which a backboard and the basket-carrying hoop of the invention are mounted is generally contoured to present an angled top surface which directs a ball back to the player of the game. This occurs when the ballwhich travels downwardly through the hoop and the basket, and then impinges upon the base.

Prior art "basketball games" and similar structures falling within the area of interest involving the present invention, are often of a cumbersome and heavy construction, and require significant assembly time. Others, which are fabricated of more fragile materials are often objectionably weak and unstable. It is a principal aim of the present invention to provide a light-weight, yet rigid and easily-erected game assembly which has broadened utility in its optional uses, which is exceedingly stable and reliable in construction and readily adjustable in height, and which includes other important features such as a safety-drop hoop and a ball-returning or bounce-back base.

SUMMARY OF THE INVENTION

The present portable, readily-assembled and disassembled self-standing game structure includes a pedestal-like base for standing on a supporting substrate. An elongate post-like standard attached to the base extends upwardly therefrom and supports, at its upper end, an upwardly extending backboard and an outwardly projecting ring or hoop to which a basket is secured. The base is formed with a top surface which is angled so that a ball passing through the basket and impinging upon the base is directed to return to a player positioned in front of and facing the backboard.

The hoop or ring which carries the basket is so mounted as to pivot downwardly from its extended mode should excessive forces be applied to the hoop during use. The hoop may then readily and easily be repositioned to its functional mode, each of the above transitions or operations occurring or being conducted without any damage to the mechanical structure itself.

The backboard, which is fabricated of transparent plastics material, is preferably imprinted with indicia designating intended areas of ball contact relevant to the various games which may be played utilizing the assembly of the invention.

Another important feature of the invention is that the elongated post is infinitely adjustable within the limits of its height through the use of intertelescoping tubes in conjunction with a simple, frictionally-locking collar and cooperating stabilizing rings or sleeves, obviating any need for pre-drilled holes and locking pin combinations and similar structures.

A related feature of the invention is that the wedge-like band serving as the means for lockingly securing the tubular standard in any selectable position of extension encircles that telescoping tube having the smaller diameter and projects partially into the outer tubular section for establishing weight-supporting frictional forces between the two tubular sections, securing these sections fixed against relative sliding movement therebetween.

In a preferred embodiment of the invention, the basket-carrying hoop is hingedly and pivotally secured in place, and is pivotable downwardly to override a retaining shoulder, upon the application of excessive downward force on the hoop or ring. An inwardly and downwardly tapering camming surface beneath the support shoulder facilitates the pivotal repositioning of the hoop to its outwardly-projecting, supported use-mode An important post-stabilizing feature of the present invention is the inclusion of band-like spacers between the tubular sections to take up the spacing therebetween, thereby preventing relative radial shifting movement between these tubular elements, and contributing to the realization of a stabilized assembly.

Other and further objects, features and advantages of the invention will be evident upon a reading of the following specifications considered in conjunction with the drawings.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in conjunction with the accompanying drawings in which like reference numerals identify like elements and in which:

DETAILED DESCRIPTION OF ILLUSTRATED EMBODIMENT

Figure 1:
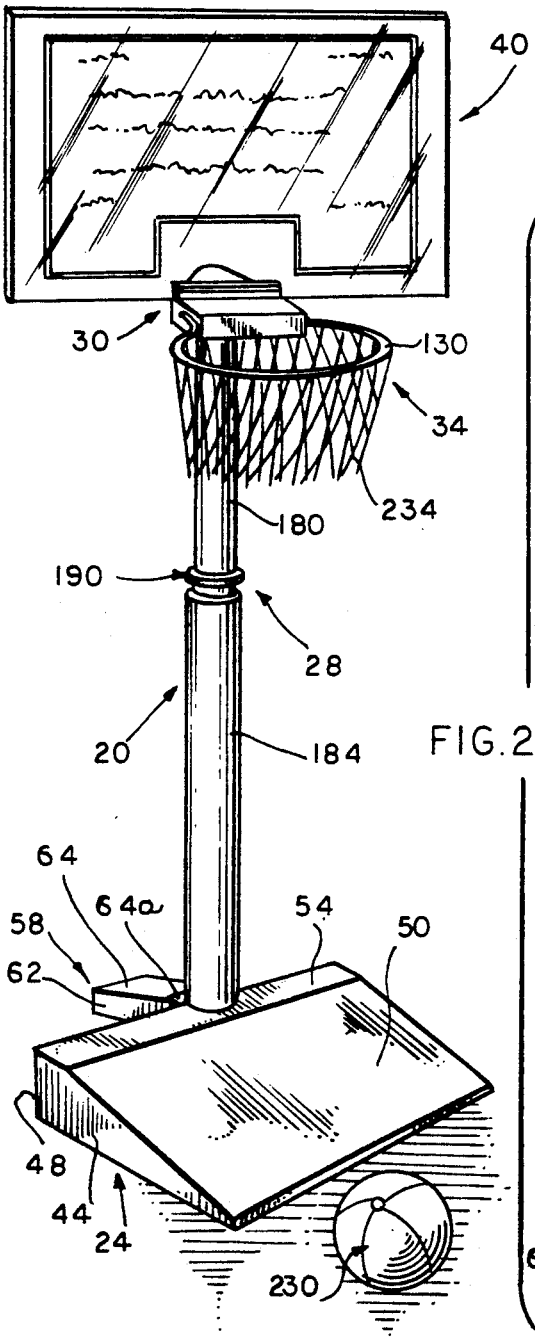
FIG. 1 is a perspective view of a portable game assembly according to the invention, embodying the features thereof.

The objects of the invention are accomplished by providing in a portable game assembly an improved post-mounted basket which is responsive to excessive forces applied thereto to pivot or break away from its horizontally extending mode, and to swing downwardly. The basket hoop is then readily returned to its initial, functional position. In a preferred embodiment of the invention, there is provided a base or pedestal which is generally wedge-shaped in form and is contoured to present to a ball dropped through the basket, a pitched, or angled impact face which serves to direct a ball which has fallen through the hoop and basket and which has then impinged on the pedestal to return toward a player positioned in front of and facing the backboard. In the preferred embodiment of the invention illustrated, the post or standard includes elongated tubular components of different overall transverse diameters, the smaller of the two posts being slidably insertable into the larger. A split bushing, or collar, which has a tapered wall, and a radially outwardly extending flange serves as a coupling between the two tubular components so that the height of the overall standard is infinitely adjustable between limits of its overall combined length. The assembly is surmounted by an upstanding backboard which may be imprinted with any preferred indicia correlated with any selectable type of game being simulated when the ball is directed toward the backboard to deflect through the ring and basket. Preferably, the entire assembly is fabricated of plastics type materials, although other compositions may be used. The ring or hoop is preferably of a metallic wire construction.

Referring now to the drawings, in a preferred embodiment of the portable game assembly of the invention, shown for illustrative purposes only and not to be construed in any limiting sense, the assembly 20 is depicted (FIG. 1) as including a base or pedestal 24, an elongate post-like adjustable standard 28 seated in and extending upwardly of the base 24, a standard surmounting assembly or bracket 30 fastened at the top of the standard 28, a ring and basket combination 34 fastened to the bracket 30 and a backboard or placard 40 attached to and extending upwardly of the bracket or bracket assembly 30.

The base or pedestal 24 is generally wedge-shaped in configuration and includes a pair of generally triangular sidewalls 44, a rear wall 48 and upwardly sloping front wall 50 and a rearwardly disposed top wall 54. As an aid to balancing and stabilizing the pedestal 24, there is provided a rearwardly extending integrally formed leg 58 which, in the preferred embodiment of the invention shown, consists of a pair of opposed sidewalls 62, a sloping top wall 64 and a front wall 68. An extension **64*a* to the top wall 64 is coplanar with the top wall 54 of the pedestal itself. The pedestal 24, which is preferably made of plastics material, is reinforced and physically strengthened (FIGS. 8 and 9) by means of a series of integrally molded panels or webs including a pair of laterally displayed side panels 70 and 72, a front panel 76 and a series of three laterally spaced front-to-rear panels 80, 82 and 84, the center 82 of the three panels extending into the leg 58 to the rear wall 68**.

Figure 8:
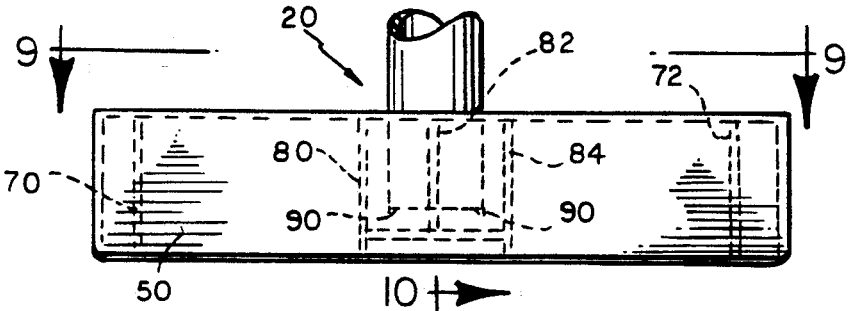
FIG. 8 is a front elevational view of the base of the game assembly showing the upright post or standard stabilized and secured therein.
Figure 9:
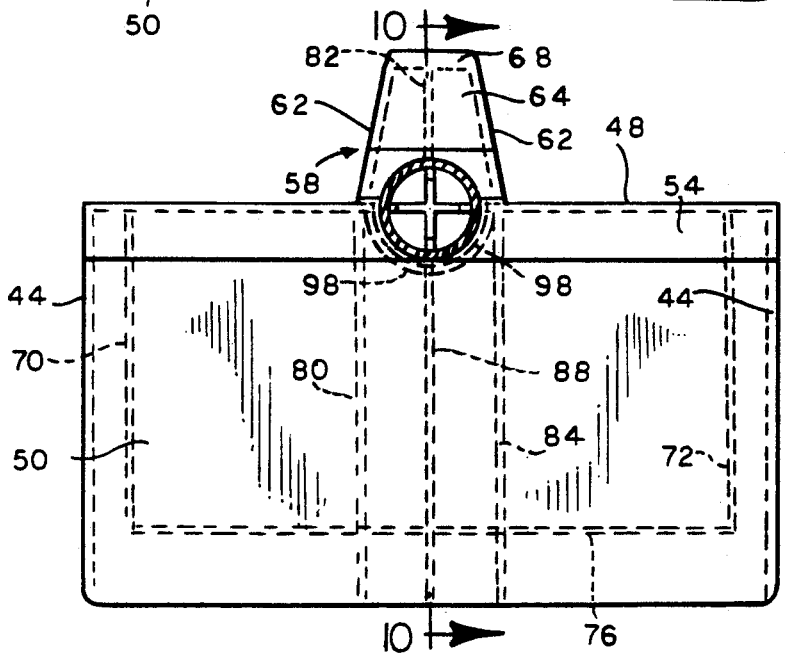
FIG. 9 is a cross-sectional view taken substantially on the lines 9—9 of FIG. 8 and showing the general configuration of the pedestal of the assembly.
Figure 10:
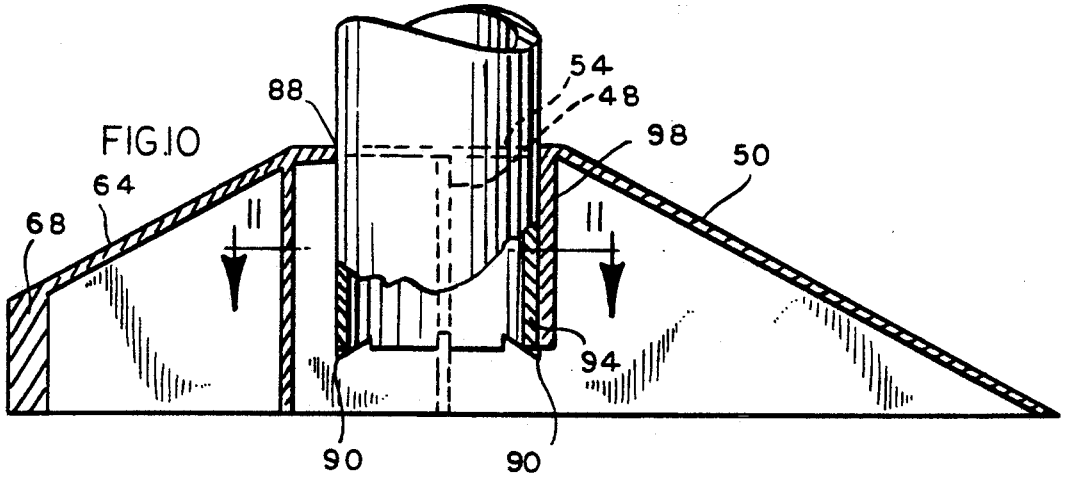
FIG. 10 is a cross-sectional view taken substantially on the lines 10—10 of FIG. 9 and showing the post or standard secured in the pedestal base, as viewed from the side.
Figure 12:
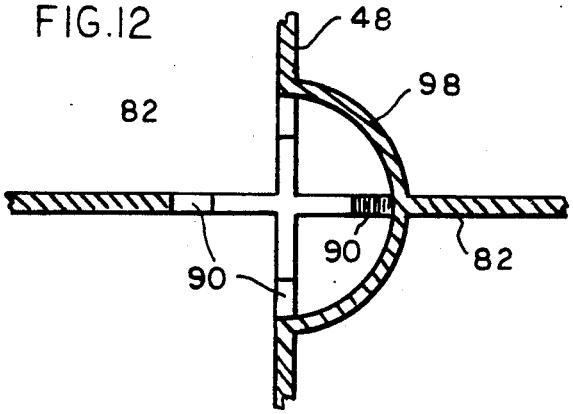
FIG. 12 is a cross-sectional view similar to FIG. 11, but with the standard removed.
Figure 11:
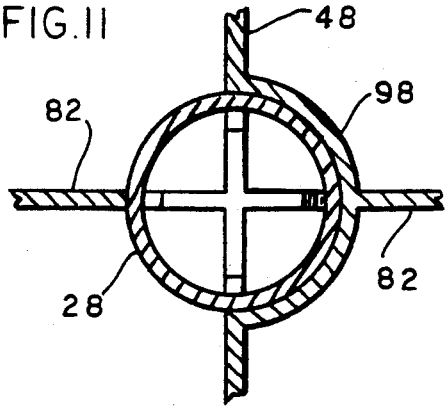
FIG. 11 is a cross-sectional view taken substantially on the lines 11—11 of FIG. 10.
Figure 13:
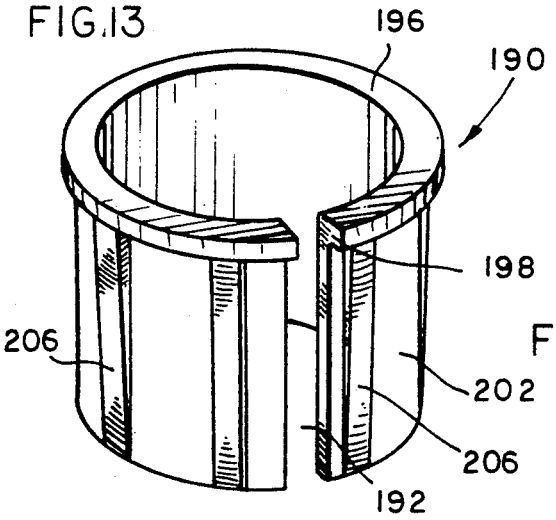
FIG. 13 is a perspective view of a split, flanged, annular collar having a tapered wall and useful as a wedge-like bushing for frictionally engaging intersleeving, telescoping components of the tubular standard to maintain the standard at selectable, adjustable lengths.

As shown in FIGS. 8–10, a round opening 88 formed in the top walls 54 and 68 of the pedestal extends through the major expanse of the rear wall 48 of the pedestal and the central strengthening flange 82 in the pedestal and in the leg 82 to form upwardly opening V-shaped slots 90 in the rear wall 48. The rearward section of the panel or flange 82 receives a lower end 94 of the standard 28 therewithin upon insertion of the standard 28 downwardly into the mating opening or socket formed in the pedestal 24. In a preferred embodiment of the invention, there is provided an integrally formed semicircular auxiliary wall 98 having an arcuate curvature of the same radius as the opening 88 in the pedestal and leg, the wall 98 providing additional physical stability and support to enhance the stabilization of the standard 28.

Referring now to FIGS. 1, 2 and 3–7, the bracket 30 which surmounts the standard 28 and supports the ring and basket assembly 30 as well as the backboard or placard 40 is, in the particular embodiment of the invention illustrated, fabricated as a unitary structure of plastics composition. A forward portion of the bracket 30 is generally rectangular in configuration and includes a top wall 100, a front wall 104, a pair of side walls 106 and 108 and a rear wall 112, the latter having a portion 114 which projects upwardly of the top wall 100. Near the top wall 100 and adjacent a juncture of the top wall 100 with the end wall 106, the latter are formed with openings 118 for receiving therewithin the inwardly directed ends or legs 122 and 124 of a ring or hoop 130. The sidewalls 106, 108 are integrally formed with generally wedge shaped projections 134, each having a top support surface 136 upon which the intermediate arm sectors 140 of the net supporting hoop 130. In the specific embodiment of the invention shown, the sidewalls 106, 108 of the bracket 30 are also formed with horizontal grooves 138 extending forwardly from the openings 118 for accommodating the arms 140 of the wire frame 130.

Spaced rearwardly from the wall 114 of the adaptor is a second wall 144, the two walls forming therebetween a slot 146 opening upwardly and laterally for receiving contiguously therewithin a backboard or placard 40. The latter is firmly supported for extension upwardly of the bracket assembly 30, as shown in FIGS. 1, 2 and 5.

Figures 3, 4, 5, 6, 7:
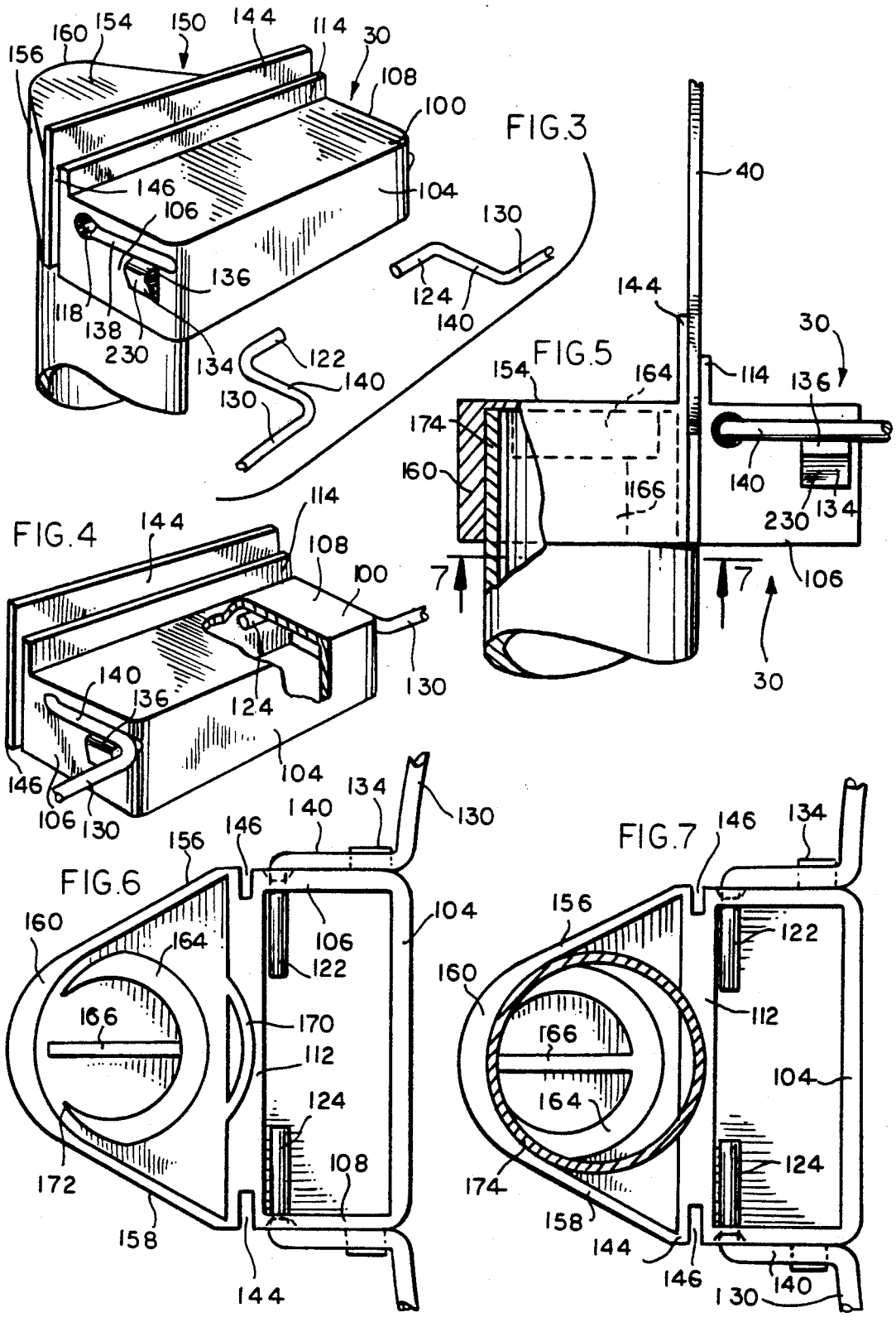
FIG. 3 is an enlarged, perspective view indicating schematically the manner of detachment of the basket hoop from the post mounted support.
FIG. 4 is a perspective view, with parts cut away, showing the mode of securement of the basket hoop.
FIG. 5 is a fragmentary, side-elevational view showing the backboard secured in place on the shaft-mounted, hoop-carrying header.
FIG. 6 is a top plan view of a header showing the socket for receiving the tubular post-like standard.
FIG. 7 is a cross-sectional view take substantially on the lines 7—7 of FIG. 5 and showing the manner in which the tubular standard is received and secured within the header.

Rearwardly of the front portion of the bracket assembly 30 is an integrally formed rear section 150, including a top wall 154, a pair of rearwardly and inwardly directed sidewalls 156 and 158 which blend as they converge to form a curved end wall 160 (FIGS. 3 and 6). As shown in FIGS. 6 and 7, the rear section 150 of the bracket 30 is formed internally with structures including a block 164, a wall 166 and an arcuate channel 170 which cooperate to define, with the end wall 160 of the housing 150, an annular slot 172 for receiving contiguously and firmly therewithin an upper end 174 of the standard 28 (FIG. 7).

Figure 2:
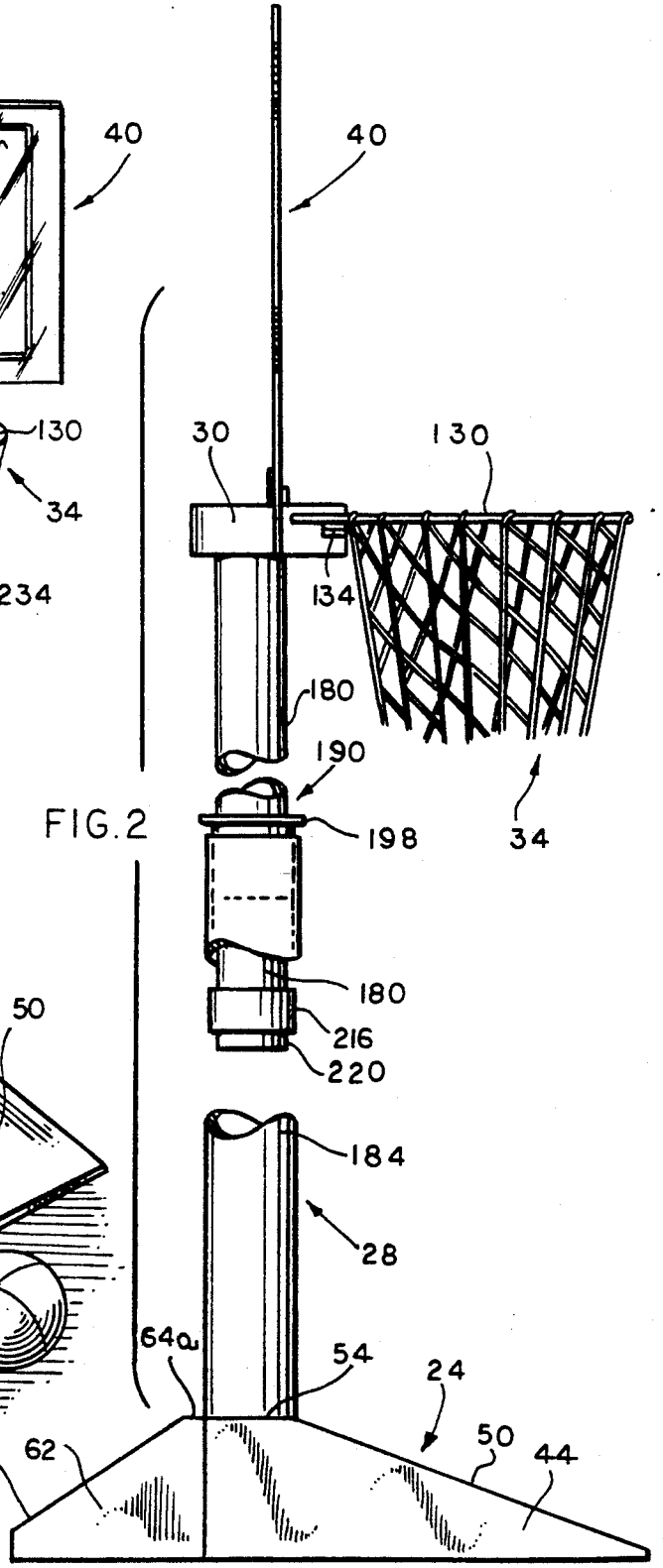
FIG. 2 is a side elevational view, with parts cut away, and showing the several principal components of the game assembly connected to one another in an operative mode.
Figure 14:
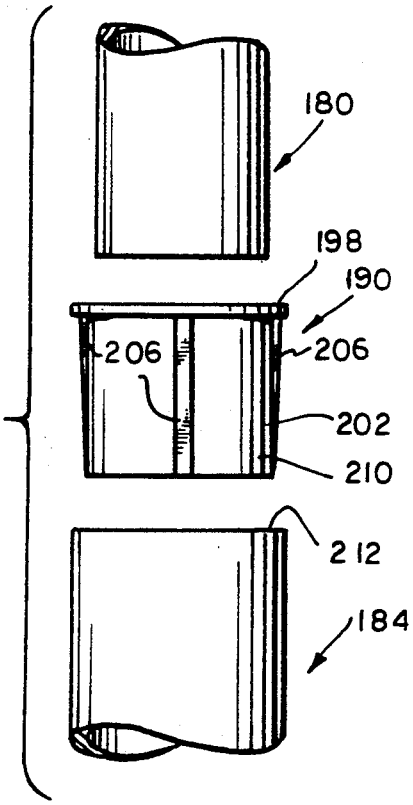
FIG. 14 is an exploded view indicating schematically the intersleeving of the tubular post sections of the standard in cooperation with the wedging bushing.
Figure 15:
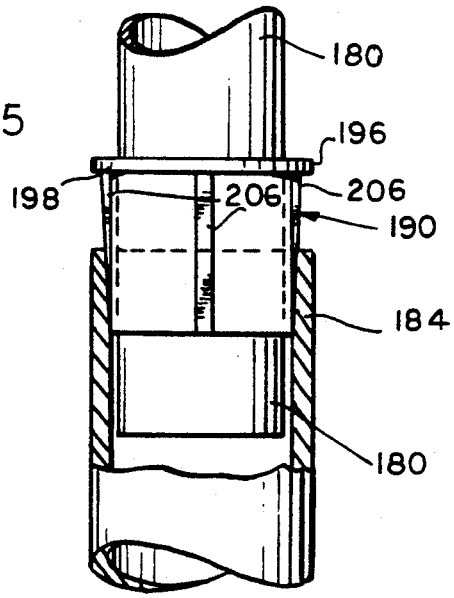
FIG. 15 is a view, partly in section, and showing the coupling of the upper and lower tubular sections, secured in a fixed position by the wedging action of the bushing-like collar.

As shown in FIGS. 1 and 2, the post 28 of the standard includes an upper pipe-like or tubular section 180 and a lower tubular section 184. The manner in which the two sections are secured and adjusted is described with reference to FIGS. 2 and FIGS. 13–15. In accordance with the practice of the illustrated embodiment of the invention, the lower section 184 of the post 28 has an interior diameter which is somewhat larger than the outer diameter of the upper section 180 of the post 28. In order to provide a readily and easily achieved selectable overall height expanse of the post 28, a simple coupling of the upper 180 and the lower 184 sections is insured by providing a bushing 190 or sleeve coupling which is split 192 longitudinally and is surmounted by an integrally formed collar or flange 196 which includes a section 198 extending radially outwardly from the annular wall 202 of the bushing 190. Integrally formed with the wall 202 and the bushing 190 are a series of annularly-spaced, longitudinally extending wedge elements 206 tapering downwardly from the underside of the collar 196. As indicated schematically in FIG. 14, and as shown in FIGS. 2 and 15, the diameter of the bushing 190 at its base is slightly less than the internal diameter of the lower section 184 of the post 28, and the upper internal diameter of the bushing 190 is slightly greater than the outer diameter of the upper section 180 of the post 28. In connecting the two sections 180 and 184 of the post 28, it is necessary merely to insert the lower section 180 through the bushing 190 to any desired extent, and then to insert the lower end 210 of the bushing 190 into the upper open end 212 of the lower section 184 of the post 28 and, thereafter, to forcibly establish a firm inter-nesting engagement between the three components 180, 190 and 184 as shown in FIGS. 2, 14 and 15.

In the specific embodiment of the invention illustrated and as shown in FIG. 2, in a preferred embodiment of the invention there is provided an additional annular sleeve 216 which may be readily slid upwardly onto the lower end of the upper section 180 of the post 28. The sleeve is so sized as to slide onto the lower extremity 220 of the upper post section 180 and to slide into the lower tubular section 184. As located, the sleeve 216 imparts a high degree of stability to the assembly, deterring angular displacement of the upper sleeve 180 within the lower sleeve 184, and to maintain the sleeves coaxial.

Referring now to FIGS. 1 and 2, an important feature of the invention is the provision of the pitched surface 50 of the pedestal 24. When a ball 230 drops through the ring 130 and through the net 234, it impinges on the sloped surface 50 and is deflected or bounces back to the player. The physical arrangement insures a convenience not heretofore realized in games of the general type involved.

Another important and practical feature and advantage of the game assembly of the invention is that upon impressing excess force downwardly on the rim 130, the arms 140 of the rim assembly are forced slidably downwardly along the surface 136 of the arm supporting wedges 134 so that mechanical damage to the structure and injury of the player are obviated. In order to reposition the ring 130 in its functional mode, it is merely necessary to pivot the ring 130 upwardly and urge the arms 140 over the camming lower surface 230 of the wedges 134 to reposition the ring 130 and the basket 234 to its functional mode.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design and others being apparent only after study. As such, the scope of the invention should not be limited by the particular embodiment and specific construction described herein, but should be defined by the appended claims and equivalents thereof. Accordingly, the aim of the appended claims is to cover all such changes and modifications as fall within the true spirit and scope of the invention.

What is claimed is:

1. In a self-standing assembly suitable for indoor or outdoor use as a game in which a ball is thrown toward a backboard and including:

a pedestal-like base for standing on a supporting substrate;

an elongate, post-like standard attached to said base and extending upwardly therefrom;

means for adjusting said standard to a selectable height dimension;

a vertically oriented backboard fastened to said standard adjacent an upper end thereof;

a ring-like hoop and means fastening said hoop to said backboard for projecting outwardly therefrom;

a tubular basket structure depending from said hoop;

said pedestal-like base being formed with a ball-impact top surface pitched downwardly of a horizontal plane and sloping downwardly and away from a point of attachment of said standard to said base;

said top surface including an areal zone beneath said hoop and generally in registry with a principal vertical axis of said hoop and directly below a ball-exiting lower opening of said hoop;

said downwardly-pitched top surface comprising means responsive to a ball falling through said hoop and impinging on said surface for directing said ball to rebound away from said backboard and along a path normal to a plane defined by said backboard, thereby promoting return of the ball to a player positioned in front of the backboard;

said means fastening said hoop to said backboard including a pair of integrally-formed, horizontally-extending support arms;

and further comprising means for releasing said hoop-supporting arms to allow said loop to abandon an outwardly projecting use mode and swingedly to pivot downwardly in response to application of excessive downwardly directed stress forces applied to said hoop;

thereby to prevent infliction of damage on force-stressed structures supporting said loop; and hoop-supporting block means and means for securing said block means to said standard at an upper end thereof;

said block means having a pair of opposed lateral sides, and said arms of said hoop extending along said lateral sides for supporting said hoop at said arms thereof;

said arms including end segments directed inwardly and toward said block means to define stub axle means invading cooperating open-ended sockets formed in said opposed lateral sides of said block means for establishing a hinged relationship therewith;

boss means on said block means at said opposed lateral sides and projecting outwardly for supporting said arms of said hoop resting thereon.

2. The improvement as set forth in claim 1 wherein application of excessive downwardly directed forces impressed on said hoop is effective to cause said arms of said hoop to override said boss means and to permit said hoop to swing downwardly about said stub axle means, and wherein said boss means are formed with downwardly extending, inwardly directed angled sidewalls defining upwardly diverging camming surfaces facilitating forced return of said hoop to a horizontal use mode upon manually pivotally swinging said hoop upwardly through an arc about said stub axle means.

* * * * *